US005282446A

United States Patent [19]

Whitefield

[11] Patent Number: 5,282,446

[45] Date of Patent: Feb. 1, 1994

[54] ROTARY PUMP ASSEMBLIES

[75] Inventor: Kevin J. Whitefield, Rochester, United Kingdom

[73] Assignee: Hobourn Automotive Ltd., Kent, England

[21] Appl. No.: 978,421

[22] Filed: Nov. 18, 1992

[30] Foreign Application Priority Data

Nov. 18, 1991 [GB] United Kingdom ..... 9124446

[51] Int. Cl.[5] ..... F02B 77/00

[52] U.S. Cl. ..... 123/198 C; 123/41.47

[58] Field of Search ..... 123/41.44, 41.47, 198 C

[56] References Cited

U.S. PATENT DOCUMENTS 3,904,318 9/1975 Born et al. ..... 417/199

4,114,586 9/1978 Whitefield ..... 123/198 C

*Primary Examiner*—Noah P. Kamen

*Attorney, Agent, or Firm*—Michael D. Bednarek

[57] ABSTRACT

A rotary servo fluid pump and a rotary water pump for an internal combustion engine have respective drive shafts which are both drivingly coupled to the rotor of the servo fluid pump by splines, keys, dogs or by having non-circular section shaft portions engaged in complementary non-circular bores in the rotor of the servo fluid pump. Flow passages of the two pumps are preferably formed in a common pump casing part which can be directly mounted on the engine block with the flow passages in open communication with respective flow galleries in the engine block. The casing part can then serve as a mounting bracket for the pumps on the engine.

16 Claims, 2 Drawing Sheets

ROTARY PUMP ASSEMBLIES

FIELD OF THE INVENTION

This invention relates to rotary assemblies and is more particularly concerned with such assemblies including one or more pumps.

SUMMARY OF THE INVENTION

According to the invention in one aspect, there is provided an assembly comprising at least two rotationally driven ancillary components for an internal combustion engine, each of which components comprises a drive shaft, and a drive rotor mounted on the drive shaft, the two drive shafts being coaxial with each other, and one of said components being a pump the drive rotor of which pump constitutes also a drive coupling interconnecting the two said shafts.

The drive rotor of the pump may be drivingly coupled to each of said two shafts by splines, keys, or dogs or may have a central bore of non-circular cross-section the ends of the shafts engaged in the bore being of complementary cross-section to the respective ends of the central bore.

Other components of the assembly may include a water pump, a servo fluid pump, a lubricant pump, a vacuum pump, a pump for an ABS system, a pump for an air-conditioning system, or auxiliary drive system.

According to a preferred feature of the invention one of said pumps is a positive displacement pump and the other of said pumps is an engine water coolant pump, and one of said pumps comprises a housing having a portion which is formed with mutually adjoining flow passages for the working fluids of both of said pumps. Preferably said portion has a flanged end and an end face to which said flow passages open, said flanged end being adapted for attachment to an internal combustion engine block with the flow passages at said end face in open communication with complementary flow passages in said engine block.

Preferably the drive rotor of said pump has an axial bore into which the drive shafts of said two components extend in driving engagement with the drive rotor of said pump.

One assembly according to the invention comprises three such pumps secured together with their respective pump rotors arranged coaxially with each other, the two endmost pump rotors being mounted on respective drive shafts and the central pump rotor having a central bore in which the drive shafts of the two endmost rotors are axially slidingly drivingly engaged.

The drive shaft of the pump at one axial end of the assembly may have a drive pulley or other rotary drive receiving member secured thereon.

The invention also provides on or for an internal combustion engine having an engine block with one or more galleries for cooling or lubricating fluids which gallery or galleries open to the external surface of the engine block, a pump including a housing and a pump rotor mounted in the housing on a drive shaft which, or an extension of which, projects from the housing and has secured thereon a rotary drive element, said housing further including a part which provides inlet and outlet passages for the pumped fluid, which part is adapted so that the pump housing is or can be mounted on the engine block with said passages in the housing in register with the opening or openings to said gallery or galleries and so that the housing forms a bracket whereby the pump is mounted on the engine block.

BRIEF DESCRIPTION OF DRAWINGS

The invention will now be described in more detail with reference by way of example to the accompanying drawings in which.

DETAILED DESCRIPTION OF THE INVENTION

Figure 1:
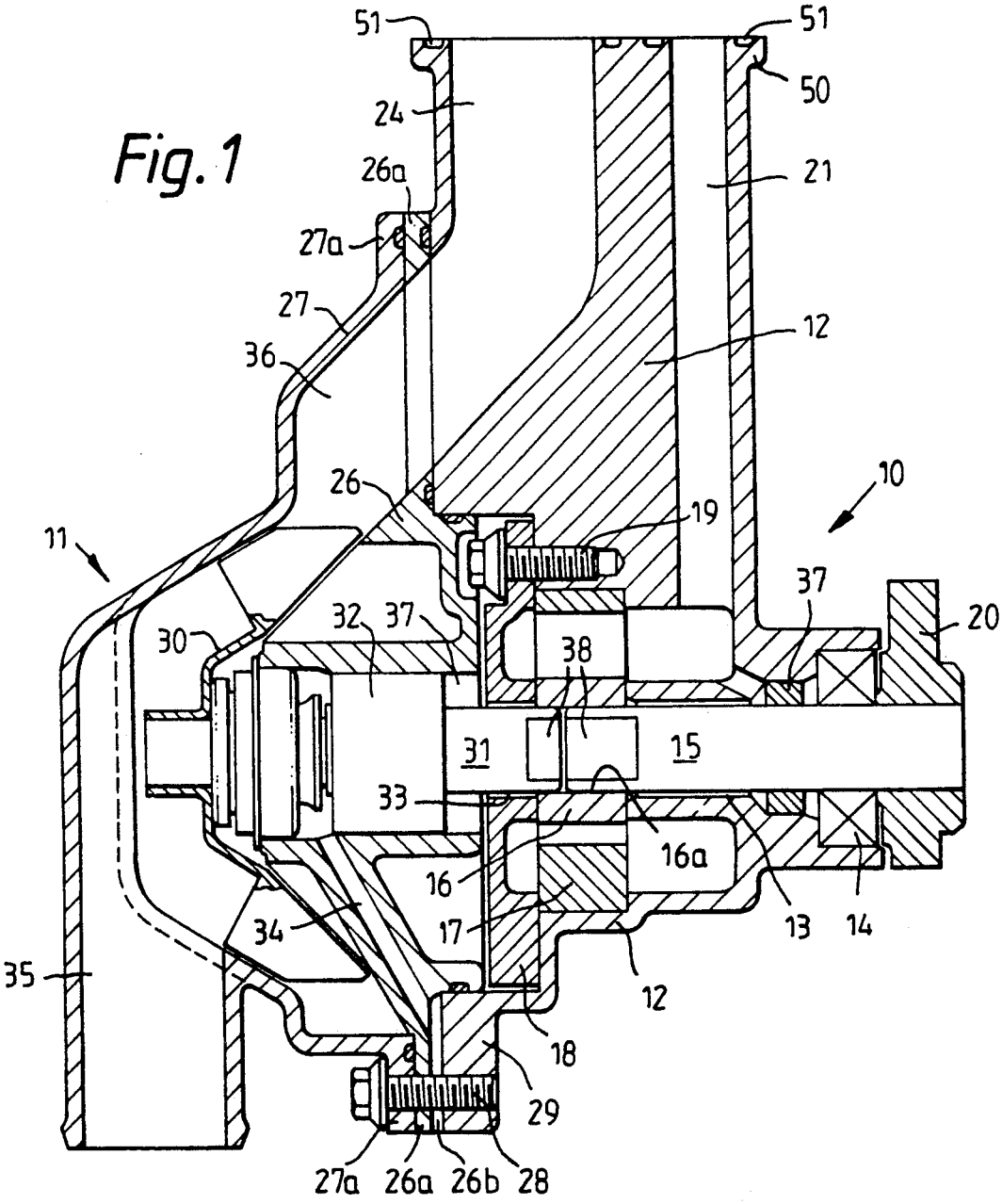
FIG. 1 shows in axial section an embodiment of the invention as applied in an assembly of two pumps.

Referring first to FIG. 1, there is shown an assembly of an engine lubricating oil pump 10 of positive displacement type and a water pump 11 for use with an internal combustion engine.

The oil pump 10 in this instance is a gerotor or N(N+1) type pump and comprises a housing 12 providing a plain bearing 13 and a rolling bearing 14 for a drive shaft 15 on which the drive rotor 16 of the pump is mounted. The driven rotor 17 of the pump encircles the drive rotor 16 and runs in a bearing recess in the housing. The rotors 16 and 17 are retained in the recess in the housing by an annular end member 18 secured to the housing by bolts 19. An input drive member 20 is secured on the outer end of the shaft 15.

The housing 12 provides inlet and outlet passages, one of which is shown at 21, for the flow of oil to and from the pump 10, and in this particular instance, provides also an outer portion 24 of the outlet passage of the water pump 11. The passages extend to a coupling flange 50 having grooves 51 for sealing rings (not shown).

The water pump has a housing formed in two parts 26, 27 having peripheral flanges **26*a*, 27*a* secured by bolts 28 to a peripheral flange 29 of the oil pump housing 12. The rotor of the water pump is formed by a centrifugal impeller 30 and is fixed on the forward end of a shaft 31 supported in a bearing 32 in the housing and extending with a clearance 33 through a central hole in the annular end member 18. Any water leaking past a shaft seal towards bearing 32 is drained away through a diagonal passage 34 and a groove 26*b* in flange 26*a* to atmosphere. The housing parts 26, 27 provide water inlet and outlet passages 35, 36 for the pump. Outlet passage 36 opens to the outlet portion 24 formed in the oil pump housing 12**.

Suitable seals 37 encircling the water pump shaft 31 and drive shaft prevent oil from the oil pump from leaking to atmosphere.

The drive rotor of one of the pumps serves also as a coupling member whereby a rotary drive is transmitted from this pump to the other. In this instance the drive rotor 16 of the oil pump has a bore **16*a* formed with two flats and the ends of the two pump shafts 15, 31 engaged in the bore each have two flats 38 so as to be of complementary cross-section to the bore 16*a* of rotor 16. The ends of the two shafts 15, 31 are axially spaced a small distance apart and are respectively in axially-sliding driving and driven engagement with the rotor 16. It will be understood that the shaft ends may alternatively have a single flat or may be hexagonal or keyed or splined and may be of different cross-sectional shape from each other provided that the bore of the rotor 16 is of complementary form. Alternatively one or both of the shafts may be drivingly connected to the rotor 16** by dogs, so arranged that the drive from the first pump to the second is transmitted through the rotor of the first pump.

Figure 2:
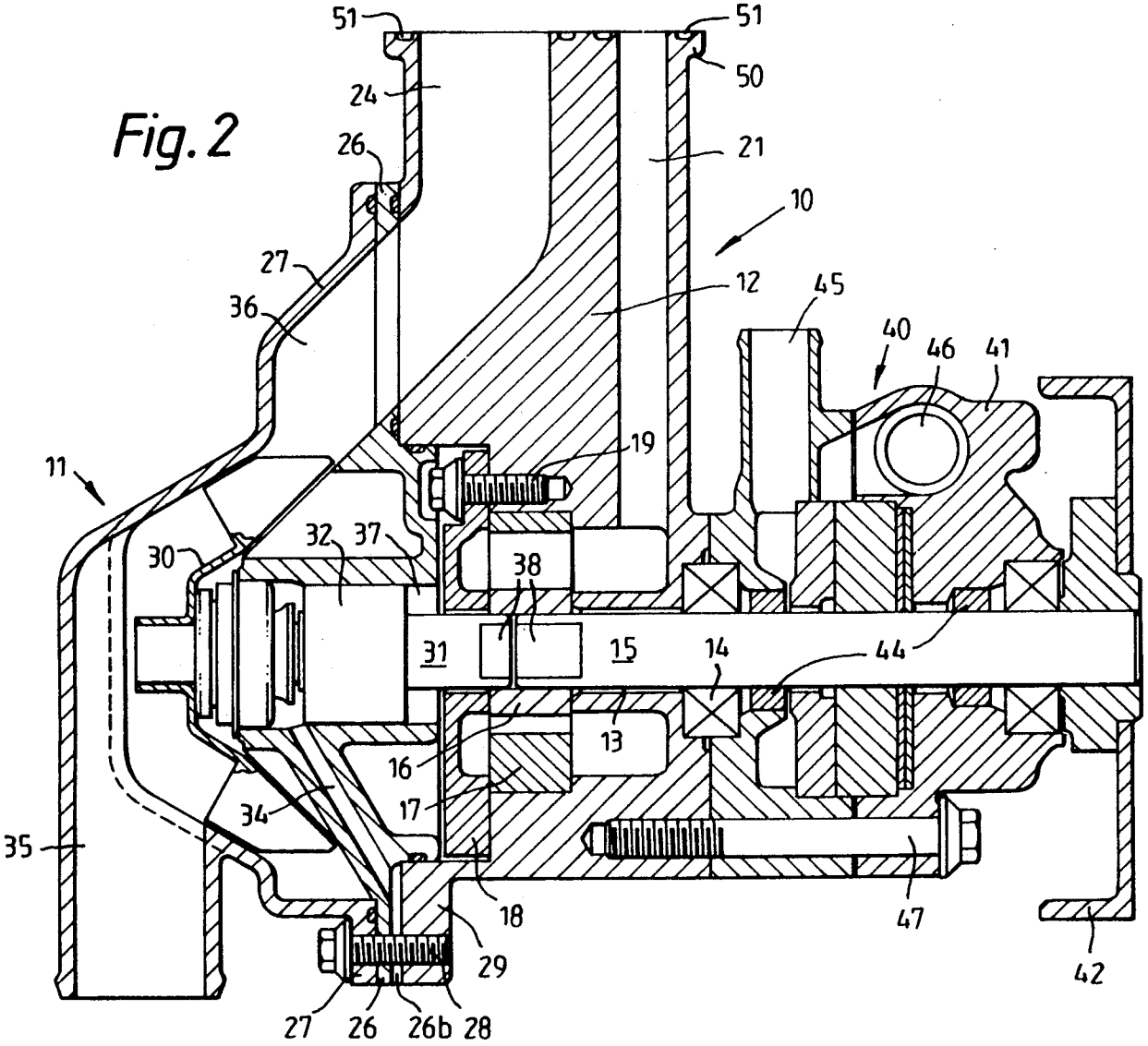
FIG. 2 shows, in axial section, an embodiment of the invention as applied in an assembly of three pumps.

Referring now to FIG. 2 of the drawings, the assembly shown comprises three coaxially disposed pumps and consists essentially of the assembly shown in FIG. 1 with the addition of a pump 40 for supplying servo fluid to a power steering motor. Components corresponding to those in FIG. 1 are indicated by the same reference numerals.

In this arrangement, the drive shaft 15 projects beyond the bearing 14 and through the housing 41 of the third pump 40 and carries on its forward end a drive pulley 42. The pump 40 is of the known roller vane type and has its driving inner rotor secured to the drive shaft 15. Seals 44 prevent leakage of servo fluid along the shaft 15. The pump housing 41 provides inlet and outlet passages 45, 46 for the servo fluid and is secured to the housing of pump 10 by bolts 47. In this construction, the outer race ring of bearing 14 constitutes also a spigot for locating housings 41 and 12 relative to each other. If desired, however, bearing 14 may be replaced by a plain bearing, in which case a direct spigot location may be provided between the two housings.

The housing 12 of pump 10 in both of the two arrangements is preferably provided with a strong bolting flange 50 extending about the outlet ends of the passages shown at 21 and 24 by which the assembly can be bolted to the engine block so that the passages 21 and 24 open directly to apertures in the engine block, which apertures communicate with oil and cooling water galleries in the engine block. Thus, the housing 12 constitutes also a mounting bracket for the assembly.

The arrangements described and illustrated are highly advantageous. Thus:

1. Since the oil pump drive rotor 16 acts both as a pumping element and a coupling between the three pumps, the need for an extra shaft, coupling and bearing is obviated.

2. The assembly can be supplied complete and ready to bolt straight onto the engine block thus saving time on the production line for the vehicle manufacturer and minimizing assembly mistakes.

3. The engine is simplified and more compact, thus providing cost savings. The cost and complication of providing a separate drive for each pump is avoided by driving two or more pumps from one pulley.

4. The cost and complication of hoses can be reduced by connecting the fluid galleries of the pumps directly to the engine block through the pump housing mounting bracket.

5. The pumps are all outside the engine and are therefore more accessible for servicing. Each of the three pumps in the arrangement of FIG. 2 can be replaced separately. Indeed the water pump or steering pump can be removed without disturbing the other pumps. The number of components, complication, weight and cost is reduced by having components serving more than one function. Thus the bracket housing 12 provides the mounting for these three pumps and may further provide the mounting of an alternator, air conditioning pump, etc. It may further provide mountings for sensors, control switches, water thermostat and oil filter. It also provides water and oil galleries to the engine and obviates the need for a separate oil pump housing. It provides the location diameter for all three pumps, thus reducing eccentricity errors.

7. Since the water pump is secured to the oil pump and its galleries, the oil system is warmed up quickly by the water on a cold start and is cooled by the water when the engine becomes hot, thus improving lubrication and oil durability.

I claim:

1. An assembly comprising two rotationally driven pumps for an internal combustion engine, each of said pumps comprising a housing and a pump rotor mounted for rotation in the housing, the pump rotors being drivingly coupled together, the housing of one of said pumps having flow passages connected to the two pumps respectively with portions of said flow passages extending side by side, said housing of said one pump having a joint face to which said flow passages open and being adapted to having said joint face secured against a complementary joint face of the engine.

2. In combination, an internal combustion engine comprising an engine block having a joint face and incorporating galleries for two liquids which galleries open to respective apertures at said joint face, and an assembly comprising two rotationally driven pumps for an internal combustion engine, each of said pumps comprising a housing and a pump rotor mounted for rotation in the housing, the pump rotors being drivingly coupled together, the housing of one of said pumps having flow passages connected to the two pumps respectively with portions of said flow passages extending side by side, said housing of said one pump having a joint face to which said flow passages open and being adapted to have said joint face secured against said joint face of the engine block, whereby said flow passages respectively communicate with said galleries.

3. An assembly comprising three rotationally driven components each incorporating a drive rotor and two of said components having respective drive shafts which are coaxial with each other and on which the drive rotors of said two components are drivingly mounted, the third of said components being a pump with the drive rotor thereof constituting also a drive coupling interconnecting the two said shafts.

4. An assembly as claimed in claim 3, wherein the drive rotor of said pump is radially supported by the drive shafts of said two components.

5. An assembly as claimed in claim 3, wherein the drive rotor of said pump has an axial bore into which the drive shafts of said two components extend in driving engagement with the drive rotor of said pump.

6. An assembly as claimed in claim 5, wherein said axial bore is of non-circular section, and wherein the shafts where they extend into said bore are of complementary non-circular section to the bore.

7. An assembly as claimed in claim 3 wherein said three components comprise respective housings in which the drive rotors are respectively disposed, two of said housings being in spigoted engagement with each other.

8. An assembly as claimed in claim 3, wherein said third component is a positive displacement pump and one of the other components is an engine water coolant pump.

9. An assembly as claimed in claim 8, wherein one of said pumps comprises a housing including a portion which is formed with mutually adjoining flow passages for the respective working fluids of the two pumps.

10. An assembly as claimed in claim 9, wherein said portion has a flanged end with an end face to which said flow passages open, said flanged end being adapted for attachment to an internal combustion engine block with the flow passages at said end face in open communication with complementary flow passages in said engine block.

11. An assembly comprising first and second rotationally driven ancillary pumps for an internal combustion engine which pumps include first and second drive shafts respectively which are coaxial with each other, and respective pump rotors mounted on the drive shafts, the pump rotor of one of said pumps constituting also a drive coupling interconnecting the two shafts wherein one of said pumps is a positive displacement pump and the other of said pumps is an engine water coolant pump, one of said pumps having a housing including a portion which is formed with mutually adjoining flow passages for the respective working fluids of both of said pumps.

12. An assembly as claimed in claim 11 further comprising a further rotationally driven ancillary component for said engine, said further ancillary component having a drive rotor drivingly mounted on the first said drive shaft.

13. An assembly as claimed in claim 12, wherein said positive displacement pump is disposed axially between the engine water coolant pump and said further ancillary component and wherein the drive motor of said positive displacement pump has an axial bore into which said first and second drive shafts extend in driving engagement with the drive rotor of said positive displacement pump.

14. An assembly as claimed in claim 13, wherein said axial bore is of non-circular section, and wherein the shafts where they extend into said bore are of complementary non-circular section to the bore.

15. An assembly as claimed in claim 11, wherein said portion of said housing has a flanged end with an end face to which said flow passages open, said flanged end being adapted for attachment to an internal combustion engine block with the flow passages at said end face in open communication with complementary flow passages in said engine block.

16. An assembly as claimed in claim 11, wherein said further ancillary component and said positive displacement pump comprise respective housings which are in spigoted engagement with each other for maintaining the drive rotors of said positive displacement pump and the further ancillary component coaxial.

* * * * *